US005111972A

United States Patent [19]

Sakurai et al.

[11] Patent Number: 5,111,972

[45] Date of Patent: May 12, 1992

[54] CREAMY SUBSTANCE CONTAINER

[75] Inventors: Yoshihumi Sakurai, Fujieda; Yuzi Ideshita, Yokohama; Takashi Sugiyama, Higashi-Murayama, all of Japan

[73] Assignees: Pola Chemical Industries Inc., Shizuoka; Yoshida Industry Co., Ltd., Tokyo, both of Japan

[21] Appl. No.: 631,059

[22] Filed: Dec. 19, 1990

[30] Foreign Application Priority Data

Jul. 11, 1990 [JP] Japan ..... 2-72951[U]

[51] Int. Cl.[5] ..... B67D 5/52

[52] U.S. Cl. ..... 222/135; 222/390; 222/391; 401/68; 401/69

[58] Field of Search ..... 222/129, 134, 135, 136, 222/137, 386, 390, 391; 401/66, 68, 69

[56] References Cited

U.S. PATENT DOCUMENTS

| | | | |
|---|---|---|---|
| 2,546,195 | 3/1951 | Mellette | 401/69 |
| 3,774,809 | 11/1973 | Bratton | 222/137 |
| 4,240,566 | 12/1980 | Bergman | 222/135 |
| 4,770,556 | 9/1988 | Ackermann | 401/69 |
| 4,850,516 | 7/1989 | Seager | 222/390 |
| 4,865,231 | 9/1989 | Wiercinski | 222/390 |

FOREIGN PATENT DOCUMENTS

| | | | |
|---|---|---|---|
| 1116300 | 6/1968 | United Kingdom | 401/68 |

*Primary Examiner*—Michael S. Huppert
*Assistant Examiner*—Joseph A. Kaufman
*Attorney, Agent, or Firm*—Wenderoth, Lind & Ponack

[57] ABSTRACT

A container is capable of containing a plurality of creamy substances and of simultaneously extruding the plurality of creamy substances through holes formed in an upper wall. The container includes a tubular case provided with a plurality of chambers for containing the plurality of creamy substances, a tubular member disposed in each chamber for axial movement, a hollow cylinder rotatably fitted over the tubular member and having longitudinal teeth on its outer surface, the hollow cylinder being interlocked with the tubular member by means of screw threads, an extrusion plunger, fitted in each chamber for axial movement and including a plate member fitted in the chamber in a liquid-tight manner and a tubular boss projecting downwardly from the plate member, the latter being fitted between the tubular member and the hollow cylinder, and an operating member capable of simultaneously rotating the two hollow cylinderes. The operating member is moved to turn the hollow cylinders by a predetermined angle so that the extrusion plungers are raised simultaneouly by a predetermined distance in the chambers to extrude the creamy substances.

14 Claims, 8 Drawing Sheets

CREAMY SUBSTANCE CONTAINER

BACKGROUND OF THE INVENTION

1. Field of the Invention

The present invention relates to a creamy substance container capable of containing a plurality of creamy substances and of simultaneously extruding the plurality of creamy substances and, more specifically, to improvements in an extruding mechanism for a creamy substance container.

2. Description of the Prior Art

A container having a plurality of chambers which are capable of containing a plurality of different kinds of substances and means for simultaneously extruding the plurality of substances is disclosed in Japanese Utility Model Publication (Kokoku) No. 52-7475. This known container comprises a case provided with two longitudinal chambers formed by longitudinally partitioning its interior space, screw shafts longitudinally extended in respective chambers, extrusion plungers each provided with an internally threaded center hole and placed nonrotatably within the respective chambers in screw-engagement with the respective screw shafts, and an operating wheel held in the lower part of the case with a portion thereof protruding outwardly thereof, the wheel being interlocked with the screw shafts. When the operating wheel is rotated by a user, the extrusion plungers are raised simultaneously by the screw shafts.

This known container, however, is intended for containing solid substances and is not suitable for containing creamy substances. If creamy substances would be contained in this known container, they might flow from the upper section of each chamber into the lower section thereof through gaps around the screw shaft or might clog the gaps to hinder the smooth rotation of the screw shaft relative to the extrusion plunger. This means that the raising mechanism for raising the extrusion plungers must be isolated in a liquid-tight fashion from the substances contained in the upper sections of the chambers, and each extrusion plunger must be provided with an internally threaded boss extending downwardly from the lower surface of the extrusion plunger, instead of the threaded center hole, for engagement with the screw shaft. Such a structure requires a space of a volume equal to or greater than the volume of the section for containing the creamy substances above the extrusion plungers, which inevitably increases the size of the container without increasing the capacity for containing the creamy substances.

In order to overcome such disadvantages, one might consider to apply a raising mechanism in a container disclosed in Japanese Utility Model Publication (Kokai) No. 53-521 or 54-11101 to the above known container having plural chambers. Each of these containers is provided with a two-stage raising mechanism comprising a screw shaft provided within a case having a single chamber, a tubular member provided within the case, and an intermediate tubular member provided with an external thread in its outer circumference and with an internal thread in its inner circumference and interposed between the screw shaft and the tubular member. This mechanism can raise the extrusion plunger by a distance twice the distance raised by the mechanism in the Publication No. 52-7475 for the same angle of rotation of the operating wheel. However, since the extrusion plunger is raised by the agency of both the external and internal threads of the intermediate tubular member when the operating wheel is turned, the rise of the extrusion plunger for a fixed angle of rotation of the operating wheel is excessively large, so that it is difficult to control precisely the rise of the extrusion plunger and therefore the amount of discharge of the substance contained in the container.

Such a disadvantage is not a significant problem in extruding a solid material because it can be returned into the container by rotating the operating wheel in the reverse direction when the material is extruded excessively. However, a creamy substance, once extruded, cannot be returned into the container even if the extrusion plunger is retracted from the raised position. Accordingly, in extruding a creamy substance, the operating wheel must be rotated very carefully, and any excessive portion of the extruded creamy substance would be wasted.

SUMMARY OF THE INVENTION

The present invention has been made in view of the problems of the foregoing conventional containers, and it is therefore an object of the present invention to provide a container capable of containing a plurality of creamy substances and of simultaneously extruding both of them, and provided with a raising mechanism which requires only a small space for installation and allows extrusion plungers for extruding the creamy substances to raise by a small distance relative to a predetermined angle of rotation of an operating means.

According to the present invention, a container capable of containing a plurality of creamy substances and of simultaneously extruding such plurality of creamy substances includes a tubular case formed with through holes in an upper wall thereof and a plurality of chambers formed within the case for containing the plurality of creamy substances. A tubular member is disposed in each chamber to be movable in the longitudinal direction thereof and nonrotatable relative to the case, the tubular member having formed on a lower portion thereof a first external thread and an interlocking means formed at an upper portion thereof. A hollow cylinder is rotatably fitted over the tubular member and has longitudinal teeth on the outer surface thereof and an internal thread on the inner surface thereof. An extrusion plunger is disposed nonrotatably in each chamber for axial movement to extrude the respective creamy substance from the respective through hole. The plunger includes a tubular boss fitted between the tubular member and the hollow cylinder and a plate member formed at the upper end of the tubular boss. The tubular boss has on the outer surface thereof a second external thread and on the inner surface thereof an engaging means for engagement with the interlocking means of the tubular member, while the plate member is fitted in the chamber in a liquid-tight manner. The internal thread is in engagement with one of the first and second external threads. Further, an operating means is movably disposed in the lower portion of the case. The operating means is adapted to engage the teeth of each hollow cylinder for turning the hollow cylinders, whereby the movement of the operating means causes the hollow cylinders to turn by a predetermined angle for elevating the extrusion plungers through one of the first and second external threads engaging with the internal thread.

When the operating means is moved by a finger of a user, the hollow cylinders engaging the operating means are rotated by a predetermined angle corresponding to a distance of movement of the operating means. Since the extrusion plungers and the tubular members are restrained from rotation, the extrusion plungers are raised by the action of the first or second external threads engaging the internal threads of the hollow cylinders to extrude the creamy substances simultaneously through the holes.

The raising or elevation of each extrusion plunger is carried out with two stages. During the first stage, each extrusion plunger is raised by a predetermined distance every time the operating means is moved by the agency of the second external thread engaging the internal thread of the hollow cylinder. Then, upon the disengagement of the second external thread from the internal thread, the first external thread engages the internal thread and, thereafter, the extrusion plunger is raised by the agency of the first external thread. This is the second stage. Thus, as the first and second external threads function individually, the distance of upward movement of the extrusion plunger for each stroke of the operating means is relatively small, resulting in an easy control of the amount of the creamy substances to be extruded.

BRIEF DESCRIPTION OF THE DRAWINGS

The above and other objects, features and advantages of the present invention will become more apparent from the following description taken in connection with the accompanying drawings in which.

DESCRIPTION OF THE PREFERRED EMBODIMENTS

First Embodiment

Figure 1:
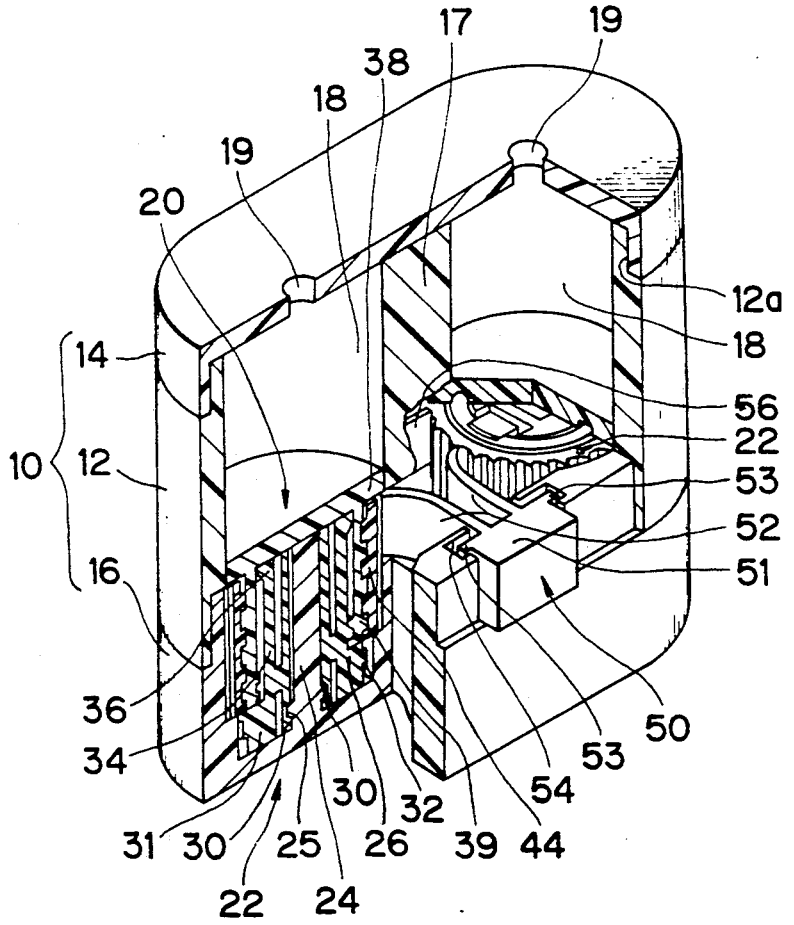
FIG. 1 is a partially cutaway perspective view of a container according to a first embodiment of the present invention.
Figure 2:
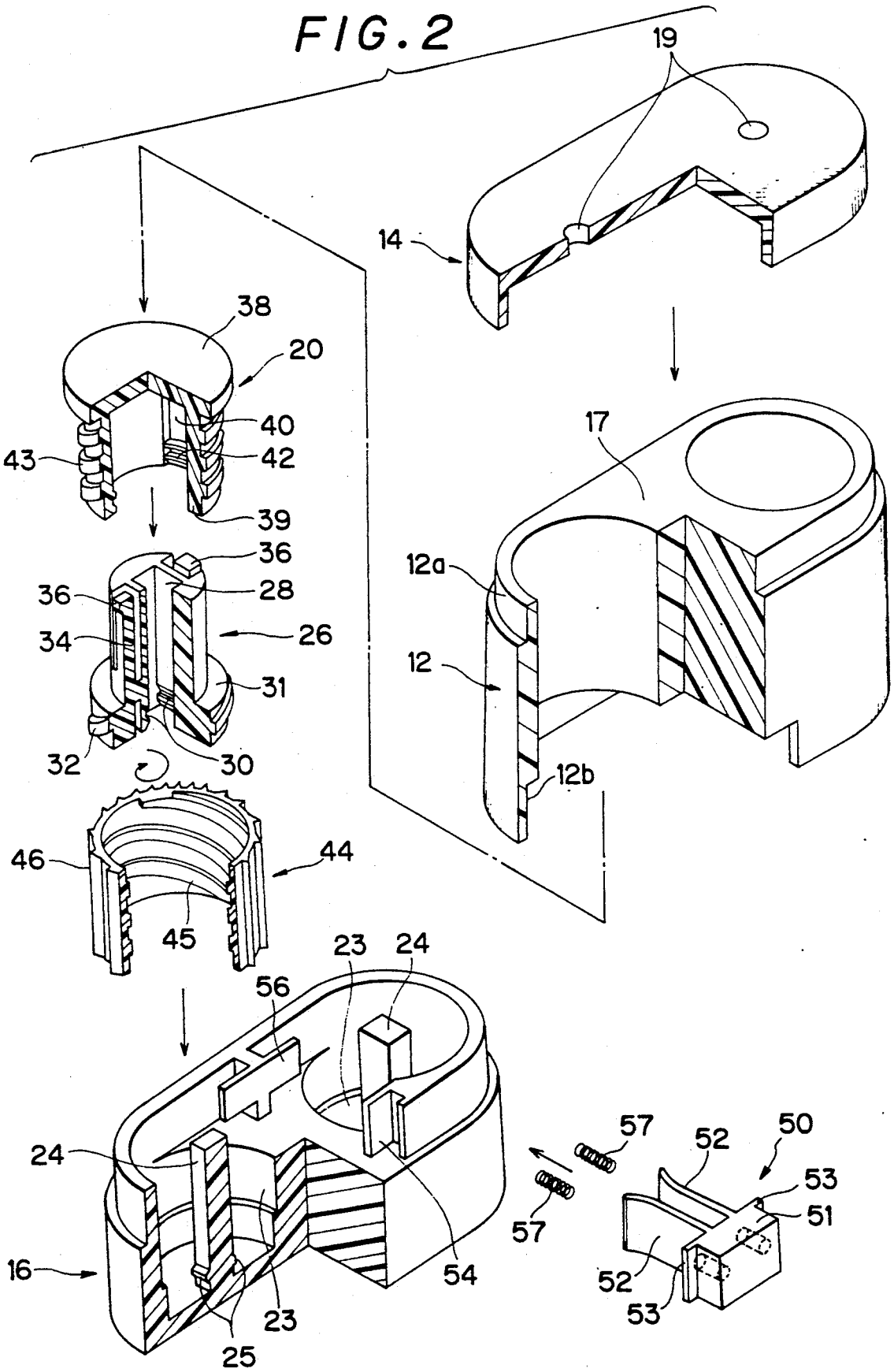
FIG. 2 is an exploded perspective view of the container of FIG. 1.

Referring to FIGS. 1 to 6, a container according to a first embodiment of the present invention has a flat tubular case 10 comprising a body 12 having open opposite ends, a top cover 14 of substantially the same configuration as the body 12 as viewed in plan and fitted on an outwardly stepped upper end 12*a* of the body 12 in a liquid-tight fashion, and a bottom cover 16 of substantially the same configuration as the body 12 as viewed in plan and fitted in a liquid-tight fashion in an inwardly stepped lower end 12*b* of the body 12. The case 10 is internally provided with a pair of longitudinally extending cylindrical chambers 18 separated from each other by a partition wall 17. Two through holes 19 are formed in the top cover 14 at positions on the axes of the respective chambers 18. An extrusion plunger 20 is fitted for axial sliding movement in each chamber 18. In this embodiment, the two chambers 18 are substantially the same in dimensions, and the two through holes 19 are substantially the same in diameter.

A pair of raising mechanisms generally indicated by 22 for raising the extrusion plungers 20 are provided in the bottom cover 16. Two cavities 23 of the same cross section as that of the chambers 18 are formed in the bottom cover 16 coaxially with respective of the chambers 18. Posts 24 having a substantially square cross section are formed integrally with the bottom cover 16 to extend along the axes of the respective cavities 23. Each post 24 is provided at the lower end of its opposite side surfaces with projections 25. Fitted on each post 24 is a tubular member 26 having at its lower end a flange 31 on the outer circumference of which is provided a first external thread 32. Each tubular member 26 is of substantially the same length as the post 24 and is provided with a square guide hole 28 along its axis to receive the post 24 slidably so that the tubular member 26 may move axially along the post 24 while it is restrained from rotation relative thereto. Grooves 30 are formed at the lower ends of the opposite side surfaces defining the guide hole 28, and the projections 25 are adapted to engage the grooves 30 to suppress the upward movement of the tubular member 26. The projections 25 and the grooves 30 may be formed respectively in the tubular members 26 and the posts 24. Each tubular member 26 is integrally provided with external flexible tongues 34 at positions corresponding to the inner side surfaces of the guide hole 28 having the grooves 30. Each flexible tongue 34 has a projection 36 projecting outwardly at its free upper extremity. The flexible tongues 34 can be bent radially inwardly and outwardly.

Figure 3:
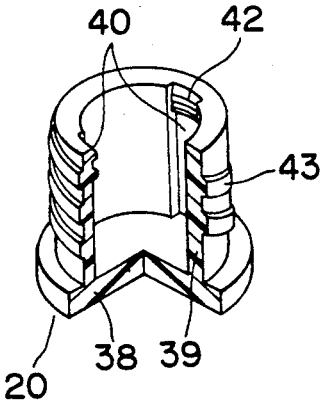
FIG. 3 is a partially cutaway prespective view of a cylindrical member in the container of FIG. 1, and shown upside down.

Each extrusion plunger 20 is fitted longitudinally slidably over a respective tubular member 26. The extrusion plunger 20 comprises a disk 38 having a diameter substantially equal to that of the respective chamber 18, and a tubular boss 39 extending from the lower surface of the disk 38. The tubular member 26 is received in the tubular boss 39, and the inside diameter of the tubular boss 39 is slightly greater than the outside diameter of the tubular member 26. As best shown in FIG. 3, a pair of longitudinal grooves 40 are formed diametrically opposite to each other in the inner surface of the tubular boss 39 so as to receive therein the projections 36 of the flexible tongues 34 to restrain the rotation of the extrusion plunger 20 relative to the tubular member 26 and to guide the extrusion plunger 20 for smooth vertical movement. Undercuts 42 are formed at the lower ends of the grooves 40 so that, when the extrusion plunger 20 is raised by a predetermined distance, the projections 36 of the flexible tongues 34 of the tubular member 26 snap into the undercuts 42 whereby the tubular member 26 can be raised together with the extrusion plunger 20. When the extrusion plunger 20 is at its lowermost position, the lower end of the tubular boss 39 is located adjacent to the upper surface of the flange 31 of the tubular member 26. The respective outside diameters of the tubular boss 39 and the flange 31 are substantially equal to each other. A second external thread 43 is formed on the outer surface of the tubular boss 39 and the pitch of this second external thread 43 is equal to that of the first external thread 32. An O ring, not shown, is fitted in an annular groove formed in the circumference of the disk 38 of the extrusion plunger 20 to provide a liquid-tight seal between the disk 38 and the inner surface of the chamber 18.

A ratchet 44 in the form of a hollow cylinder is fitted over the tubular boss 39. The ratchet 44 is provided with an internal thread 45 in its inner surface so as to engage the second external thread 43 of the tubular boss 39, and with a plurality of longitudinal teeth 46 on its outer surface. When the ratchet 44 is turned, the extrusion plunger 20 is raised by the agency of the internal thread 45 of the ratchet 44 and the second external thread 43 of the extrusion plunger 20.

An operating push piece 50 as an operating means for rotating the ratchet 44 is mounted in the lower portion of the case 10. The push piece 50 consists of a substantially rectangular button 51 and a pair of arms 52 projecting from the backside of the button 51. The button 51 is provided with a pair of flanges 53 at the inner ends of its opposite side surfaces. The push piece 50 is placed in a recess 54 formed through the central area of the front upper end of the bottom cover 16, with the flanges 53 received in an expanded area of the recess 54 having a width greater than the thickness of the flanges 53 and with the arms 52 projecting into the interior of the bottom cover 16. The extremities of the arms 52 are diverged so as to engage the teeth 46 of respective of the ratchets 44. When the button 51 of the push piece 50 is pressed inwardly, the arms 52 act on the teeth 46 of the ratchets 44 to turn the ratchets 44 by a predetermined angle. A detent 56 for preventing the ratchets 44 from rotating in reverse directions is formed in the central portion of the rear upper end of the inner surface of the bottom cover 16. The push piece 50 is biased outwardly by springs 57 provided within the recess 54. Since the respective ratchets 44 of the pair of raising mechanisms 22 are turned in opposite directions, the directions of the respective external threads 32 and 43 and of the respective internal threads 45 should be opposite to each other. All the foregoing component parts excluding the springs 57 may be formed of plastics.

The operation of the container thus constructed will be described hereinafter.

Figure 4A:
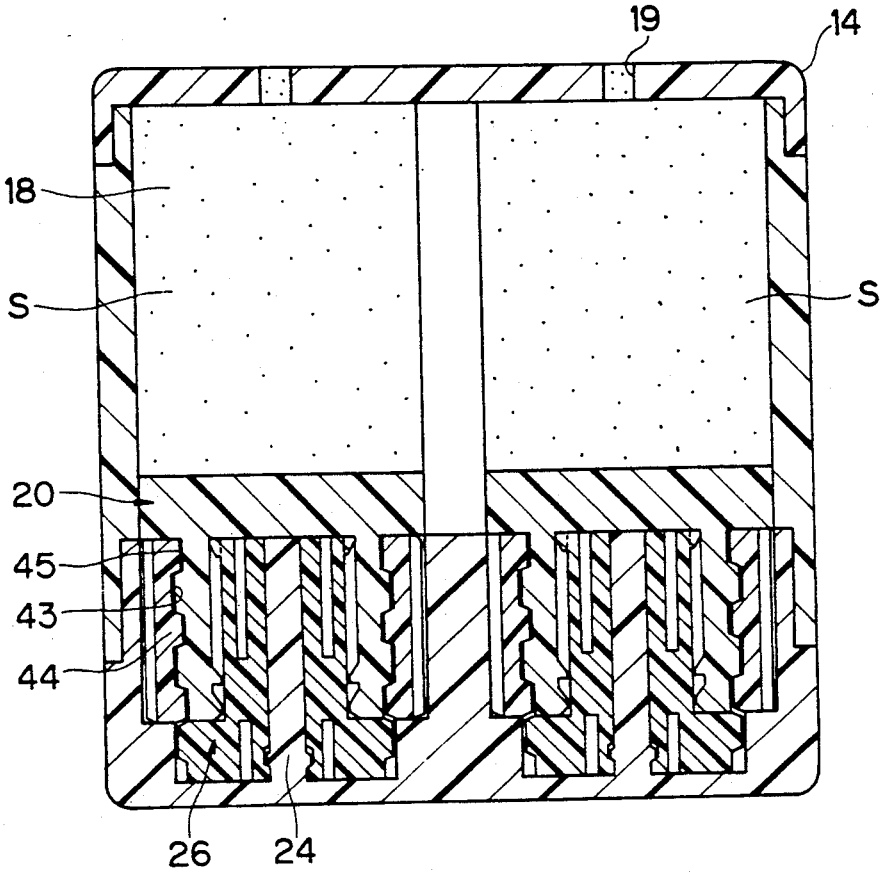
FIGS. 4(A) and 4(B) are a longitudinal sectional view and a cross sectional view, respectively, of the container of FIG. 1.
Figure 4B:
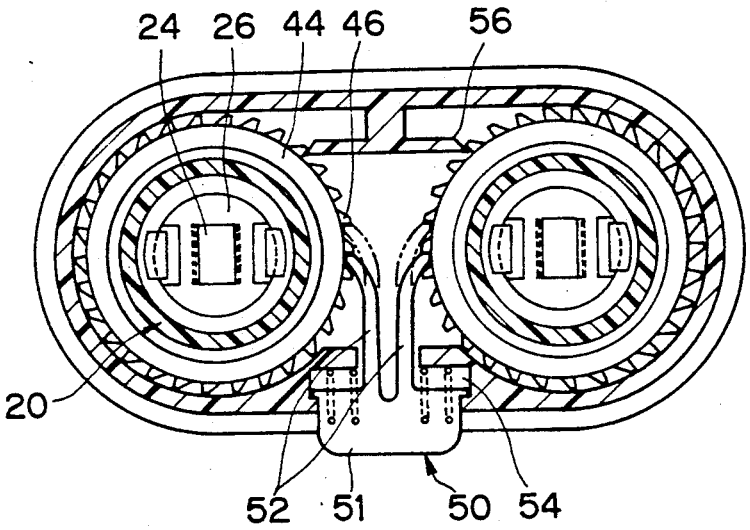

Assuming that each chamber 18 is filled with a creamy substance S and the extrusion plungers 20 are at their lowermost positions as shown in FIG. 4(A), the container 10 is held in one hand of a user and the button 51 of the push piece 50 is pushed, for example, with the thumb in order to turn the ratchets 44 through the arms 52 by predetermined angles. Since the internal threads 45 of the ratchets 44 and the second external threads 43 of the extrusion plungers 20 are engaged with each other and the extrusion plungers 20 are restrained from rotation, the extrusion plungers 20 are raised by a predetermined distance (note that the ratchets 44 are prevented from moving downwardly because the lower ends of the ratchets 44 are seated on the bottom surfaces of the cavities 23). Consequently, the creamy substances S of amounts corresponding to the distance of upward movement of the extrusion plungers 20 are extruded through the holes 19 formed in the top cover 14. As the pair of arms 52 turns the respective ratchets 44 simultaneously and by equal angles, the two extrusion plungers 20 are raised by the equal distance to extrude the two substances S simultaneously. The stroke of the push piece 50 is dependent on the width of the expanded area of recess 54 formed in the bottom cover 16. Since the upward movement of the tubular members 26 is suppressed by the engagement of the projections 25 and the grooves 30, only the extrusion plungers 20 are raised.

Figure 5:
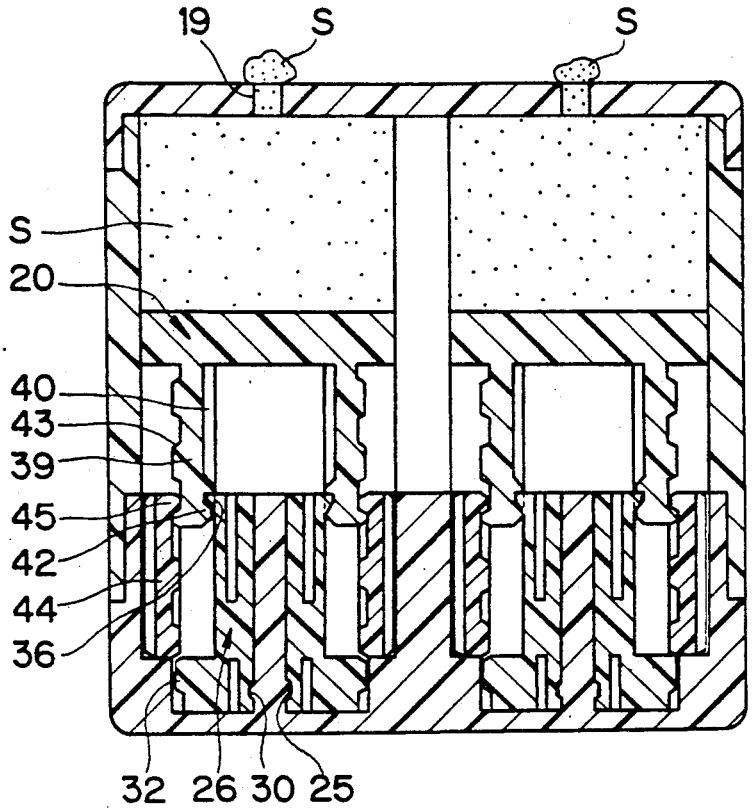
FIGS. 5 and 6 are longitudinal sectional views of the container of FIG. 1, for assistance in explaining the operation of extruding the container.
Figure 6:
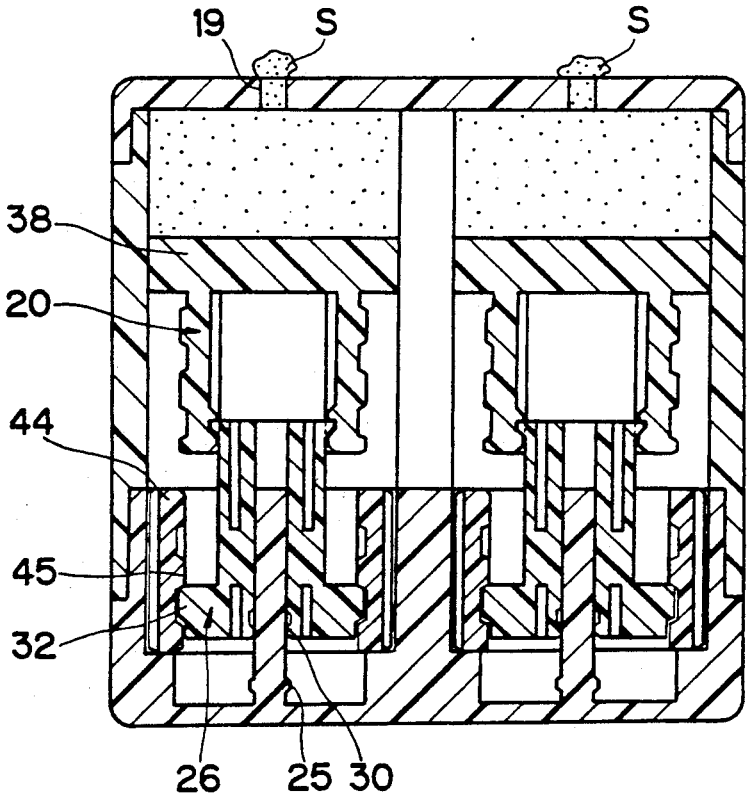

When the button 51 is released after extruding the creamy substances S, the push piece 50 is returned to its normal position by the spring 57, and the arms 52 are disengaged from the teeth 46 of the ratchets 44. Since the ratchets 44 are restrained from reverse rotation by the detent 56, the extrusion plungers 20 do not move downwardly. Thus, the extrusion plungers 20 are raised by the predetermined distance every time the button 51 is pushed to dispense the equal predetermined amounts of the creamy substances S. Upon the coincidence of the lower end of the tubular boss 39 of each extrusion plunger 20 with the upper end of the respective tubular member 26, the projections 36 of the flexible tongues 34 of member 26 engage the undercuts 42 of boss 39 as shown in FIG. 5. Thereafter, when the button 51 is further pushed, the ratchet 44 exerts upward force through the internal thread 45 and the second external thread 43 of the extrusion plunger 20 to the latter, whereby the grooves 30 of the tubular member 26 are disengaged from the projections 25 of the post 24 extending upwardly from the bottom surface of the bottom cover 16 so that the tubular member 26 is permitted to rise together with the extrusion plunger 20. Eventually, the second external thread 43 of the extrusion plunger 20 is disengaged from the upper end of the internal thread 45 of the ratchet 44, while the first external thread 32 formed on the flange 31 of the tubular member 26 engages the internal thread 45 of the ratchet 44 as shown in FIG. 6. Since the tubular member 26 is restrained from rotation by the square post 24, the tubular member 26 and the extrusion plunger 20 are raised by the ratchet 44 when the button 51 is pushed to extrude the creamy substance S through the holes 19.

Figure 7:
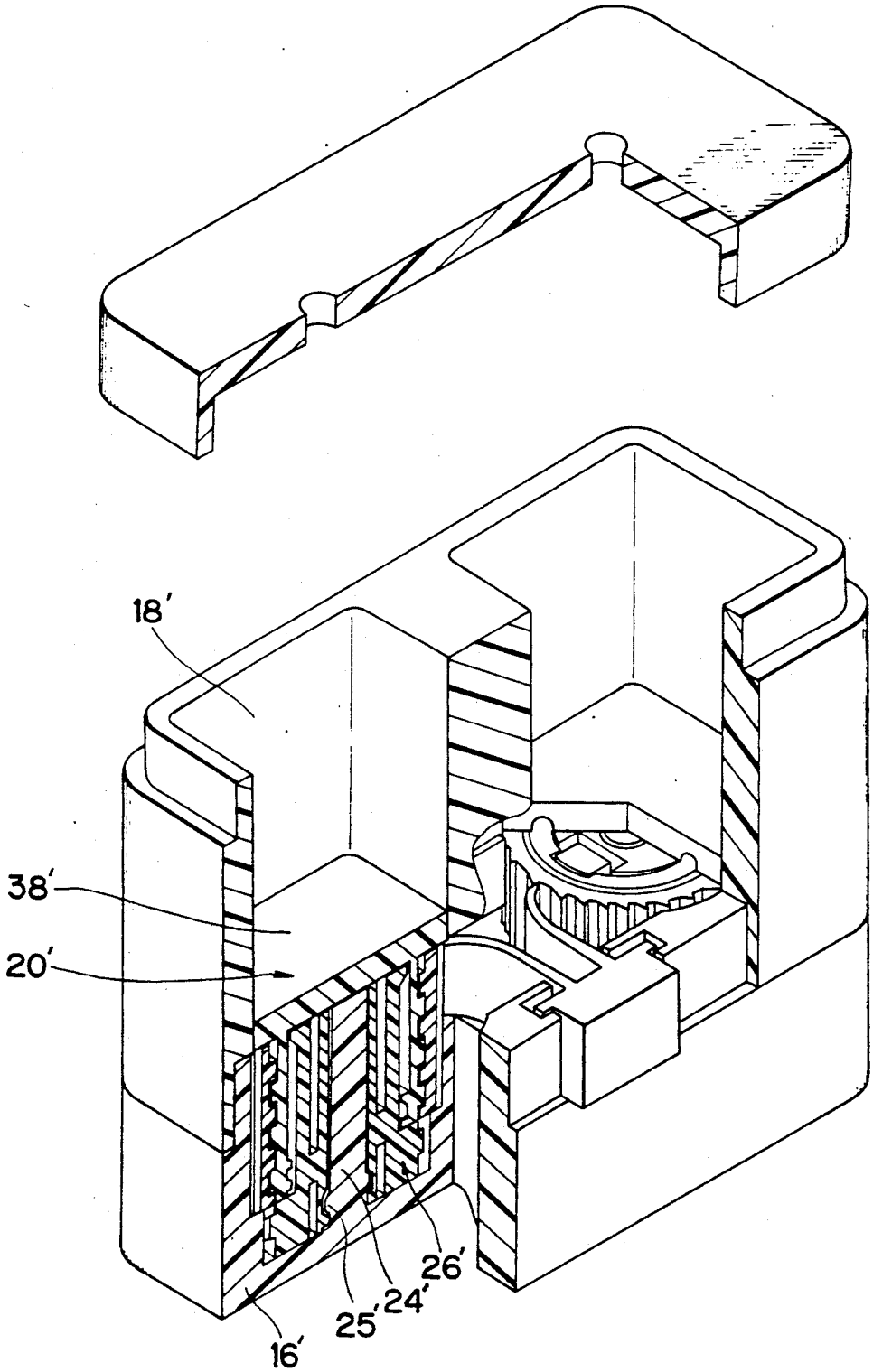
FIG. 7 is a partially cutaway exploded perspective view of the container with a slight modification.
Figure 8A:
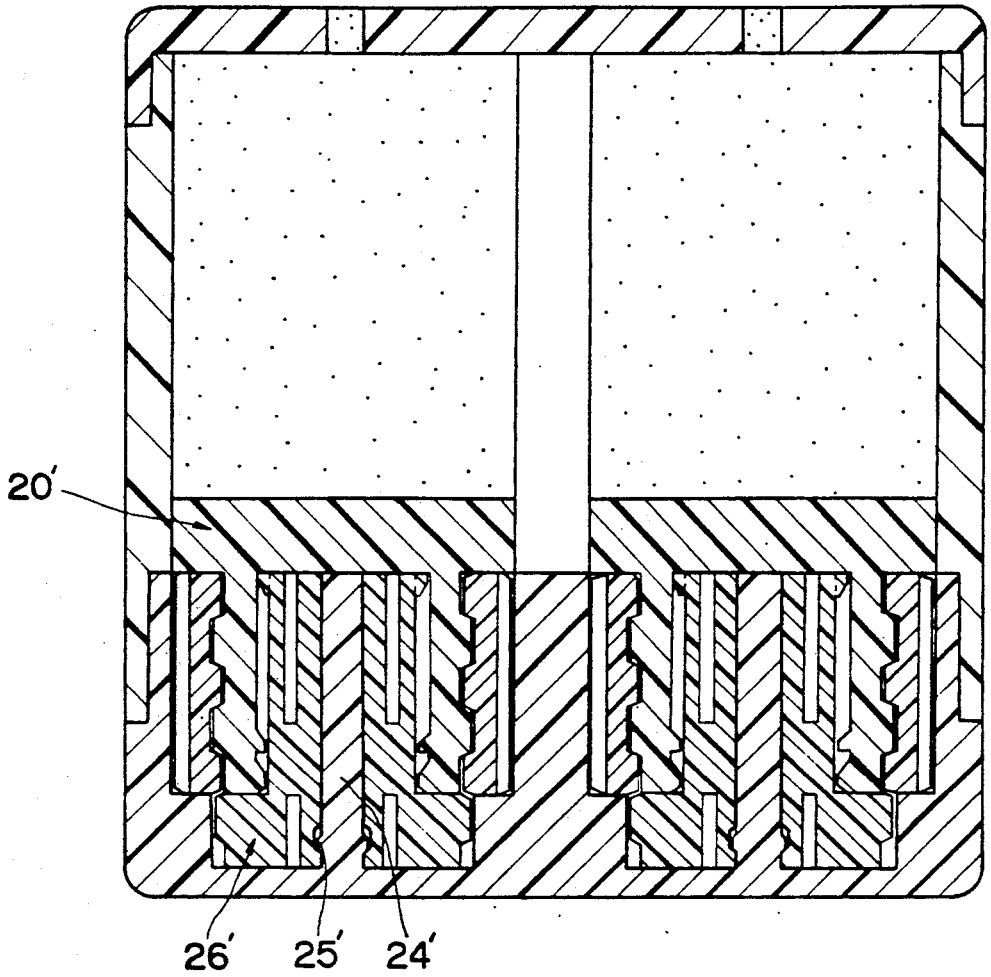
FIGS. 8(A) and 8(B) are a longitudinal sectional view and a cross sectional view, respectively, of the container of FIG. 7.
Figure 8B:
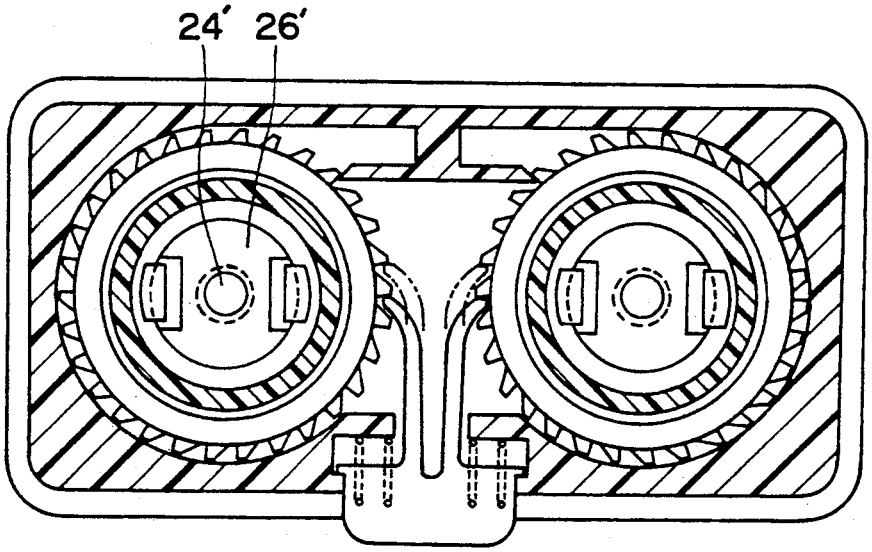

The two chambers 18 in this embodiment are formed in substantially the same dimensions (cross-sectional areas) so that the ratio between the respective amounts of the creamy substances S extruded through the respective holes, each time the button 51 is pushed is 1:1. However, the chambers 18 may be formed to have different dimensions in order to enable a user to extrude the creamy substances S at an optional ratio other than 1:1. Further, the cross section of the chambers 18 and the plan shape of the extrusion plungers 20 need not necessarily be circular, but rather may be of any suitable shape, such as an elliptical shape or a rectangular shape as shown in FIGS. 7 and 8. A container shown in FIGS. 7 and 8 employs a case provided with chambers 18' each of rectangular shape in cross section and extrusion plungers 20' each having a rectangular plate 38'. Since the combination of the rectangular chambers 18' and the rectangular plates 38' prevents the rotation of the extrusion plungers 20' relative to the case 10, posts 24' of a bottom cover 16' may be of a circular cross section and can terminate at a level just above projections 25' which are required to suppress the upward movement of tubular numbers 26'.

Second Embodiment

Figure 9:
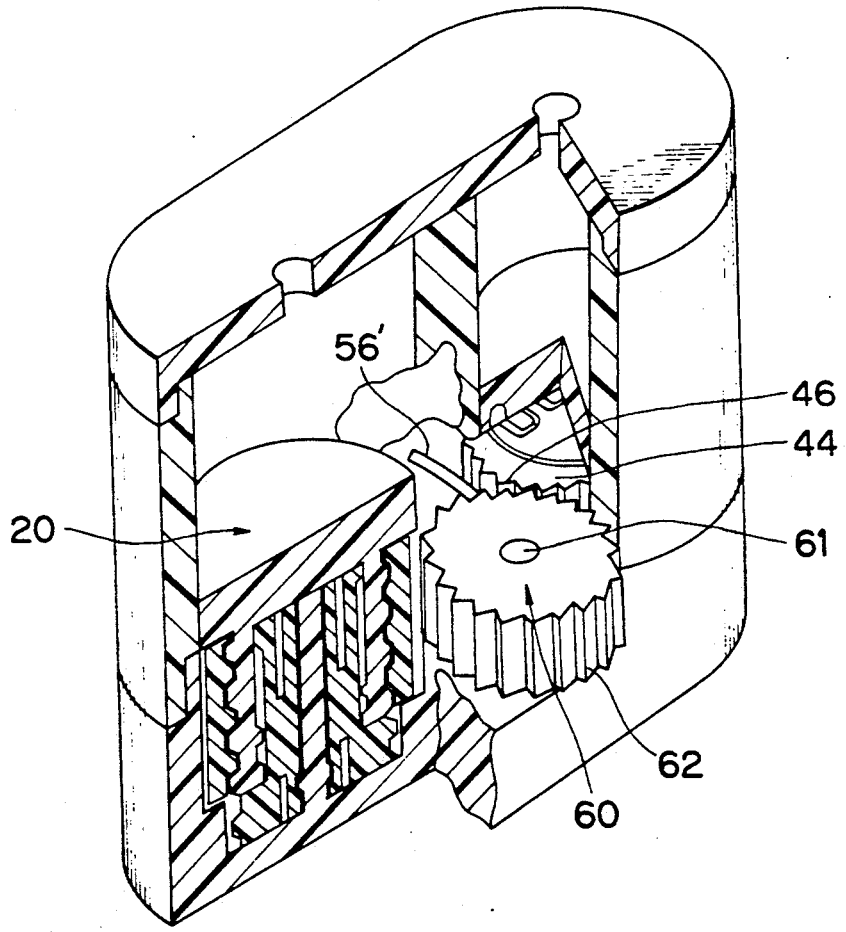
FIG. 9 is a partially cutaway perspective view of a container according to a second embodiment of the present invention.

FIG. 9 shows a container according to a second embodiment of the present invention, in which parts similar or corresponding to those previously described with reference to FIGS. 1 to 8 are denoted by the same reference characters and description thereof will be omitted.

As shown in FIG. 9, the container is provided with a rotary wheel 60 as an operating means supported on a support shaft 61 projecting from the bottom cover 16. The rotary wheel 60 is formed on its circumference with teeth 62 adapted to engage the teeth 46 of ratchets 44, and is restrained from rotation in the reverse direction by a detent 56' formed on the bottom cover 16 so as to engage a tooth 62 of the rotary wheel 60. Consequently, rotation of the ratchets 44 in the reverse direction is also prevented. Since the pair of ratchets 44 are turned in the same direction, two raising mechanisms of the same construction can be employed for raising the two extrusion plungers 20.

Third Embodiment

Figure 10:
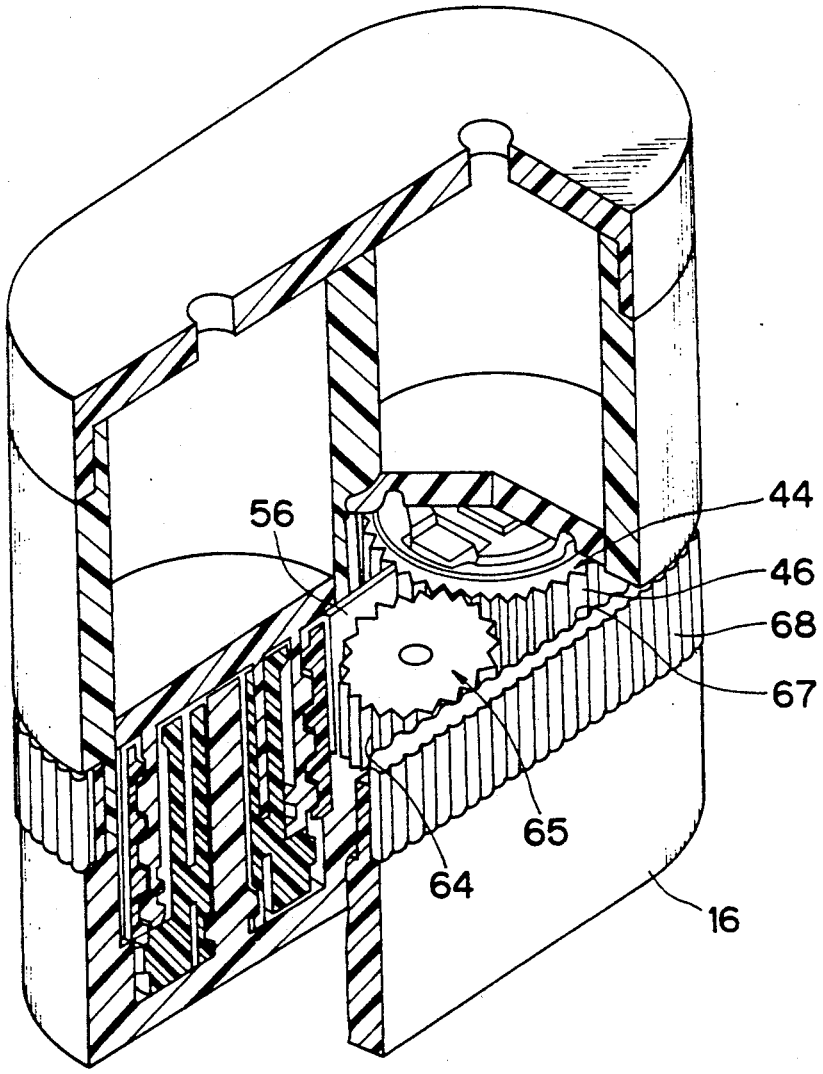
FIG. 10 is a partially cutaway perspective view of a container according to a third embodiment of the present invention.

FIG. 10 shows a container according to a third embodiment of the present invention, in which parts similar or corresponding to those previously described with reference to FIGS. 1 to 9 are denoted by the same reference characters and description thereof will be omitted. As shown in FIG. 10, the container employs an operating means comprising a gear wheel 65 provided with teeth 64 adapted to engage the teeth 46 of ratchets 44, and a toothed endless belt 68 which is formed on its inner side with teeth 67 adapted to engage the teeth 64 of the gear wheel 65. The endless belt 68 is movably wound around the upper end of the bottom cover 16 and has a corrugated outer surface to facilitate the drive of the endless belt 68 by a finger of a user. The detent 56, similar to that of the first embodiment, is formed in the bottom cover 16 so as to engage the teeth 46 of ratchets 44 for preventing reverse rotation thereof.

If desired, the detents 56 and 56' may be omitted to permit the ratchets 44 to rotate in opposite directions so that the extrusion plungers 20 and 20' also can be moved downwardly.

Although the invention has been described in its preferred forms with a certain degree of particularity, obviously many changes and variations are possible therein. It is therefore to be understood that the present invention may be practiced otherwise than as specifically described herein without departing from the scope and spirit thereof.

What is claimed is:

1. A container capable of containing a plurality of creamy substances and of simultaneously extruding the plurality of creamy substances, said container comprising:

a tubular case formed with through holes in an upper wall thereof;

a plurality of chambers formed within said case for containing the plurality of creamy substances;

a respective tubular member disposed in each said chamber movably in the longitudinal direction thereof and nonrotatably relative to said case, said tubular member having a first external thread formed on a lower portion thereof and an interlocking means formed in an upper portion thereof;

a respective hollow cylinder rotatably fitted over each said tubular member, said hollow cylinder having longitudinal teeth formed on an outer surface thereof and an internal thread on an inner surface thereof;

a respective extrusion plunger disposed nonrotatably in each said chamber for axial movement to extrude the creamy substance therein through a respective said through hole, said extrusion plunger comprising a tubular boss fitted between the respective said tubular member and the respective said hollow cylinder and a plate member formed at an upper end of said tubular boss, said tubular boss having a second external thread on an outer surface thereof and an engaging means on an inner surface thereof for engagement with said interlocking means of said tubular member, and said plate member being fitted in the respective said chamber in a liquid-tight manner;

said internal thread being in engagement with one of said first and second external threads; and an operating means movably disposed in a lower portion of said case, said operating means being adapted to engage said teeth of each said hollow cylinder for turning said hollow cylinders upon movement of said operating means, whereby the movement of said operating means causes said hollow cylinders to turn by a predetermined angle for elevating said extrusion plungers through said one of said first and second external threads being engaged with said internal threads.

2. A container as claimed in claim 1, wherein said operating means comprises a push piece having a button and a pair of arms extending from said button inwardly of said case, each said arm being engaged with said teeth of a respective said hollow cylinder in such a manner that an inward movement of said button causes said arm to turn said hollow cylinder.

3. A container as claimed in claim 2, wherein said operating means further comprises an elastic member for biasing said button to a normal position.

4. A container as claimed in claim 1, wherein said operating means comprises a rotary wheel formed on an outer surface thereof with teeth engaging said teeth of said hollow cylinders, said rotary wheel partially projecting from said case for rotation thereof by a user.

5. A container as claimed in claim 1, wherein said operating means comprises a gear wheel rotatably mounted within said case and engaging said teeth of said hollow cylinders, and an endless belt movably wound around said case and having a toothed inner surface for engagement with said teeth of said gear wheel, whereby a movement of said endless belt rotates said gear wheel to turn said hollow cylinders.

6. A container as claimed in claim 5, wherein said endless belt has a corrugated outer surface for facilitating movement thereof by a user.

7. A container as claimed in claim 1, further comprising a detent for preventing reverse rotation of said hollow cylinders.

8. A container as claimed in claim 1, wherein each said chamber has a circular cross section.

9. A container as claimed in claim 8, further comprising a respective post having a square cross section and extending from a bottom surface defining each said chamber, and wherein each said tubular member is slidably fitted on the respective said post.

10. A container as claimed in claim 9, wherein said interlocking means of each said tubular member comprises a projection formed on an outer surface thereof, and said engaging means of the respective said extrusion plunger is an undercut engagable with said projection.

11. A container as claimed in claim 10, wherein said extrusion plunger has formed in an inner surface thereof a longitudinal groove for receiving said projection to thereby prevent rotational movement of said extrusion plunger relative to said tubular member, and wherein said undercut is formed in said longitudinal groove.

12. A container as claimed in claim 11, wherein said tubular member has formed in an inner surface thereof a groove, and wherein said post has formed on a lower portion thereof a second projection engagable with said groove for normally preventing an upward movement of said tubular member.

13. A container as claimed in claim 1, wherein each said chamber has a rectangular cross section.

14. A container as claimed in claim 1, wherein each said tubular member has formed at a lower end thereof a flange, said first external thread being formed on an outer surface of said flange.

* * * * *